US007896697B2

(12) United States Patent
Dennes

(10) Patent No.: US 7,896,697 B2
(45) Date of Patent: Mar. 1, 2011

(54) SCREENING DEVICE FOR REDUCING ELECTROMAGNETIC COUPLING

(75) Inventor: Wayne William Dennes, Wyoming (AU)

(73) Assignee: ADC GmbH, Berlin (DE)

( * ) Notice: Subject to any disclaimer, the term of this patent is extended or adjusted under 35 U.S.C. 154(b) by 0 days.

(21) Appl. No.: 12/440,676

(22) PCT Filed: Jul. 18, 2007

(86) PCT No.: PCT/EP2007/006368

§ 371 (c)(1),
(2), (4) Date: Mar. 10, 2009

(87) PCT Pub. No.: WO2008/034480

PCT Pub. Date: Mar. 27, 2008

(65) Prior Publication Data

US 2009/0239418 A1 Sep. 24, 2009

(30) Foreign Application Priority Data

Sep. 19, 2006 (AU) ..... 2006905178

(51) Int. Cl.
*H01R 13/648* (2006.01)

(52) U.S. Cl. ..... 439/607.08

(58) Field of Classification Search ..... 439/607.08, 439/607.09, 607.01, 607.05, 607.13, 404
See application file for complete search history.

(56) References Cited

U.S. PATENT DOCUMENTS

| | | | | |
|---|---|---|---|---|
| 4,405,187 | A | 9/1983 | Muller et al. | |
| 4,452,502 | A | 6/1984 | Forberg et al. | |
| 4,541,682 | A | 9/1985 | Gerke et al. | |
| 5,160,273 | A | 11/1992 | Carney | |
| 5,772,472 | A | 6/1998 | Beutler et al. | |
| 7,311,532 | B1 | 12/2007 | Bippus et al. | |
| 7,381,092 | B2 | 6/2008 | Nakada | |
| 7,510,438 | B2 * | 3/2009 | Hammond et al. | 439/607.01 |

FOREIGN PATENT DOCUMENTS

| | | |
|---|---|---|
| EP | 1 453 152 | 9/2004 |
| JP | 7-73931 | 3/1995 |
| WO | WO 99/36993 | 7/1999 |
| WO | WO 2005/067108 | 7/2005 |
| WO | WO 2005/083849 | 9/2005 |
| WO | WO 2006/029668 | 3/2006 |

* cited by examiner

*Primary Examiner*—Phuong K Dinh
(74) *Attorney, Agent, or Firm*—Merchant & Gould P.C.

(57) ABSTRACT

A screen (60) for reducing the electromagnetic coupling between a first and a second adjacent pair (62, 64) of electrical connectors (52), which are arranged in a row of pairs of electrical connectors (52) in a connector block (10), contains a first electrically conducting surface (66) which is shaped for arrangement between the first and the second adjacent pair (62, 64) of electrical connectors (52); and two electrically conducting surfaces (68, 70) spaced apart, which are electrically coupled with corresponding sections of the first electrically conducting surface (66) and which stand up from these sections in the transverse direction, in a common direction, and form a three-sided screen for a pair of electrical connectors (52).

21 Claims, 6 Drawing Sheets

SCREENING DEVICE FOR REDUCING ELECTROMAGNETIC COUPLING

This application is a National Stage Application of PCT/EP2007/006368, filed 18 Jul. 2007, which claims benefit of Ser. No. 2006905178, filed 19 Sept. 2006 in Australia and which application(s) are incorporated herein by reference. To the extent appropriate, a claim of priority is made to each of the above disclosed applications.

TECHNICAL FIELD OF THE INVENTION

The present invention relates to a screen for reducing electromagnetic coupling between adjacent groups of electric connectors in a connector block.

BACKGROUND OF THE INVENTION

In the telecommunications industry, voice and data signals are often transmitted over long distances along groups of closely spaced transmission lines. In order to maintain flexibility as equipment is added or replaced in a telecommunications system, it is important to have connection stations at one or more locations where connections to a large number of pieces of equipment can be made.

Electromagnetic radiation and interference are generated between adjacent transmission lines, particularly where the lines are spaced closely together. The radiation can cause electromagnetic coupling between adjacent transmission lines which can adversely affect the information being transmitted. For example, the radiation can generate "crosstalk" in the transmission lines. The effects of crosstalk can be reduced by transmitting the information over twisted pairs, or over wires that are encased in a conductive sheath, for example. Such techniques may be useful for reducing crosstalk over the extent of the transmission lines. However, the transmission lines are ultimately terminated at connector blocks located at connection stations. The conductors in the connector blocks are closely spaced apart and, as such, there is a tendency for crosstalk. However, it may not be practical to use the described techniques for reducing crosstalk in connector blocks.

The problem of crosstalk may not be particularly severe at low frequencies of less than 16 megahertz (MHz), for example. However, there is a demand for transmission at much higher frequencies, such as 100 MHz and more, and, at those frequencies, radiation is higher and there is a greater tendency for crosstalk.

A screening device for the insulation displacement contacts (IDCs) of a connector block is described in U.S. Pat. No. 5,160,273. Here the problem of crosstalk between adjacent groups of electric connectors, such as IDCs, is solved by inserting electrically conductive screening plates between adjacent pairs of IDCs. The plates are inserted into slots which extend transversely to the longitudinal direction of the plastic body of the connector block and contact a base rail situated in the longitudinal direction of the inside of the plastic body of the connector block. A disadvantage of this arrangement is that, when fitting the component into the plastic body, it is first necessary to fit the base rail, which has contact tongues for contacting the individual screening plates, and that it is subsequently necessary to push the individual screening plates into the connector block. Consequently, the complexity of assembly is relatively high.

Notwithstanding the fact that the screening taught by U.S. Pat. No. 5,160,273 may reduce crosstalk in connector blocks, it may still allow unacceptably high levels of crosstalk at high frequency data transmission rates.

It is generally desirable to overcome or ameliorate one or more of the above mentioned difficulties, or at least provide a useful alternative.

SUMMARY OF THE INVENTION

In accordance with one aspect of the invention, there is provided a screen for reducing electromagnetic coupling between first and second adjacent pairs of electric connectors arranged in at least one series of pairs of electric connectors in a connector block, including:

(a) a first electrically conductive surface shaped for arrangement between the first and second adjacent pairs of electric connectors;

(b) two spaced apart electrically conductive surfaces electrically coupled to, and extending transversely away from, respective sections of said first electrically conductive surface in a substantially common direction, wherein said first electrically conductive surface and said spaced apart electrically conductive surfaces are adapted to provide electrically conductive screening on three sides for a pair of connectors in the series. Transversely is to be understood in this sense in such a way that the two other surfaces lead off from the first surface and form a three-sided open structure, the pair of connectors being surrounded on three sides within the structure. In this case, individual ones of or all of the surfaces can also be curved.

Preferably, this screen is integrally formed.

Further preferably, the screen has at least one means, by means of which the screen can be electrically and/or mechanically connected to a further screen. Four-sided screening is thus realized. An electrical connection without a mechanical connection can be achieved, for example, by pressing the screens against one another in a sprung manner. A mechanical connection without an electrical connection can be achieved, for example, by virtue of the fact that at least one screen is not electrically conductive at the mechanical fixing point but has electrically conductive regions which bring about screening. Preferably, however, the screens are at least electrically connected. Mention will be made of the fact that the formulation should also include at least one means or else precisely one means.

In a further preferred embodiment, the distal ends of the spaced apart surfaces have a curvature which is further preferably directed inwards towards one another. These then form the means for electrical and/or mechanical connections. In the case of a purely electrical connection, a deformation of the spaced apart electrical surfaces is controlled via the end sections if the end sections press elastically against the further screen.

Preferably, the distal ends only extend over some of the length of the end faces of the spaced apart surfaces.

In a further preferred embodiment, the screen has at least one further means, which, with a first means of a second screen, can produce an electrical and/or mechanical connection.

The second means is preferably at least one opening and further preferably a slot.

In a further preferred embodiment, the at least one slot is located between adjacent edges of the first surface and at least one of the two spaced apart surfaces, further preferably the slot being located at the bottom end of the surfaces, with the result that the distal ends can then pass through.

In a further preferred embodiment, the first electrically conductive surface and/or the two spaced apart surfaces are electrically conductive plates.

In a further preferred embodiment, the two spaced apart electrical surfaces extend at an angle of 90° (+/−10°) with respect to the first electrical surface, with the result that a U-shaped cross section is set.

In a further preferred embodiment, two spaced apart projections are arranged at a common end of the first electrically conductive surface, which projections extend into hollow pedestals in the front side of the housing and are therefore arranged directly in the region of the contact points of the connectors. Preferably, the projections in this case lie in the same plane as the first surface.

In a further preferred embodiment, the screen is substantially constructed from metal or a non-metallic electrical material.

In an alternative embodiment, the screen is constructed from an electrically non-conductive material with at least a partial conductive coating or metallic structures arranged in the interior.

A further solution consists in the provision of a screening device, at least two screens according to the invention being mechanically and/or electrically connected and forming four-sided screening for at least one pair of connectors. If the screens are mechanically connected to one another, the complete screening device or groups of screens can be inserted as one component part.

A further solution consists in providing a connector block for terminating a plurality of conductors of electric data cables, including a plurality of pairs of electric connectors for terminating said conductors and a plurality of screens according to the invention, wherein the screens are arranged around respective pairs of electric connectors.

In a preferred embodiment, the electric connectors are arranged in groups, the groups having a distance from an adjacent group which is greater than the distance between pairs of one group, which is in turn greater than the distance between the connectors of a pair. Preferably, the pairs of one group are split into two rows, in each case one connector in a row being connected to a connector of the other row. In this case, the pair in one row and the associated pair in the other row are screened by a common screen.

In a further preferred embodiment, the screens are arranged in such a way that each pair of electric connectors is provided with four-sided screening. Given the arrangement in groups, this is achieved by virtue of the fact that a screen is arranged between the groups in which no connectors are arranged and a redundant accommodating zone is provided for the screen in a group at the edge of the distribution block. Alternatively, in each case the last pair of connectors in a group can be terminated by a single plate with respect to the four-sided screening. In this case, it is also possible for the redundant accommodating zone to be dispensed with, which allows for a narrower design of the connector block. In this case, a screen is required for each pair and in each case one terminating plate per group. Alternatively, it is possible to dispense with the terminating plates, in particular if the distance between the groups is sufficiently large. In this case, apart from one pair in a group, all other pairs have four-sided screening.

In a further preferred embodiment, the connectors are insulation displacement contacts.

BRIEF DESCRIPTION OF THE DRAWINGS

Preferred embodiments of the present invention are hereafter described, by way of non-limiting example only, with reference to the accompanying drawing, in which.

DETAILED DESCRIPTION OF PREFERRED EMBODIMENTS OF THE INVENTION

Figure 1:
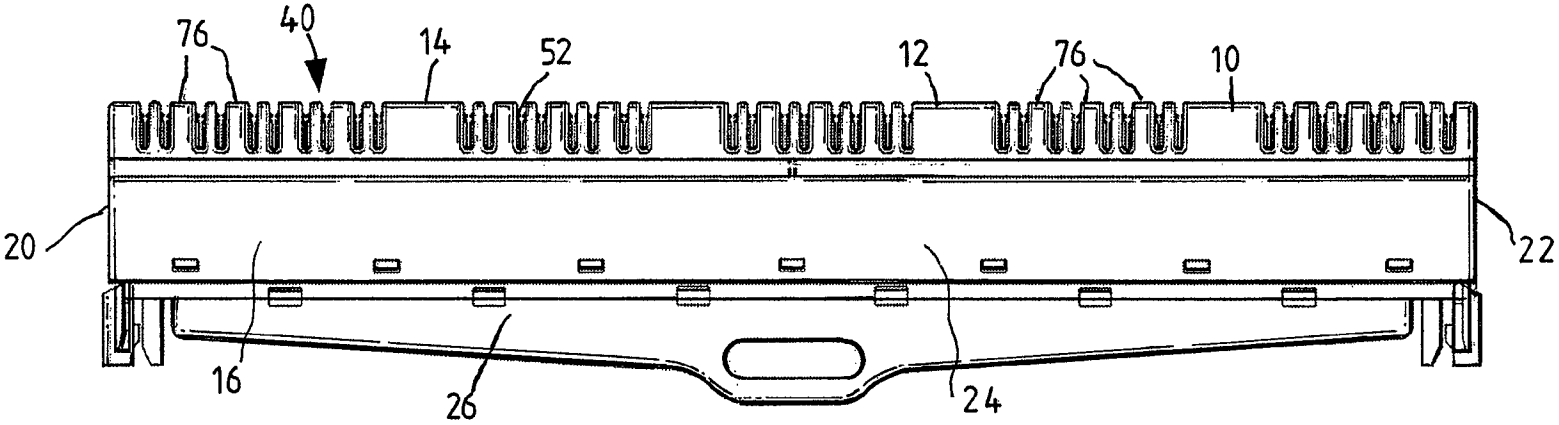
FIG. 1 is a top view of a connector block.
Figure 2:
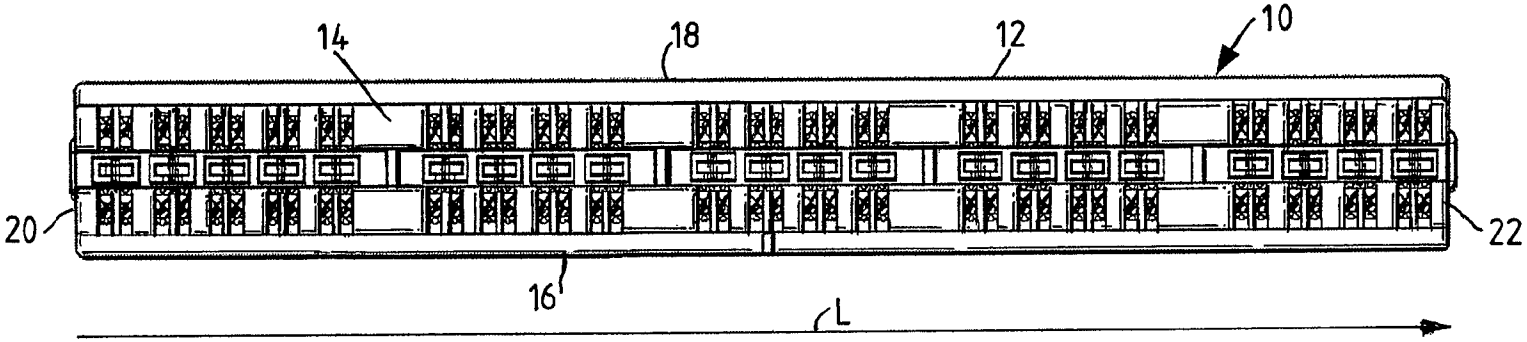
FIG. 2 is a front view of the connector block shown in FIG. 1.

The connector block 10 shown in FIGS. 1 and 2 is used to terminate the insulated conductors of electric data cables (not shown). The connector block 10 includes a generally rectangular housing 12 having a front side 14; a back side (not shown); a top side 16; and a bottom side 18. The housing 12 extends in the longitudinal direction L from a first end 20 to a second end 22. The housing 12 preferably includes a front piece 24 that connects to a base piece 26. In one embodiment, the front piece 24 is connected to the base piece 26 by a snap-fit connection. It will be appreciated that the front piece 24 defines the front side 14 of the housing 12 and the base piece 26 defines the back side of the housing 12.

Figure 3:
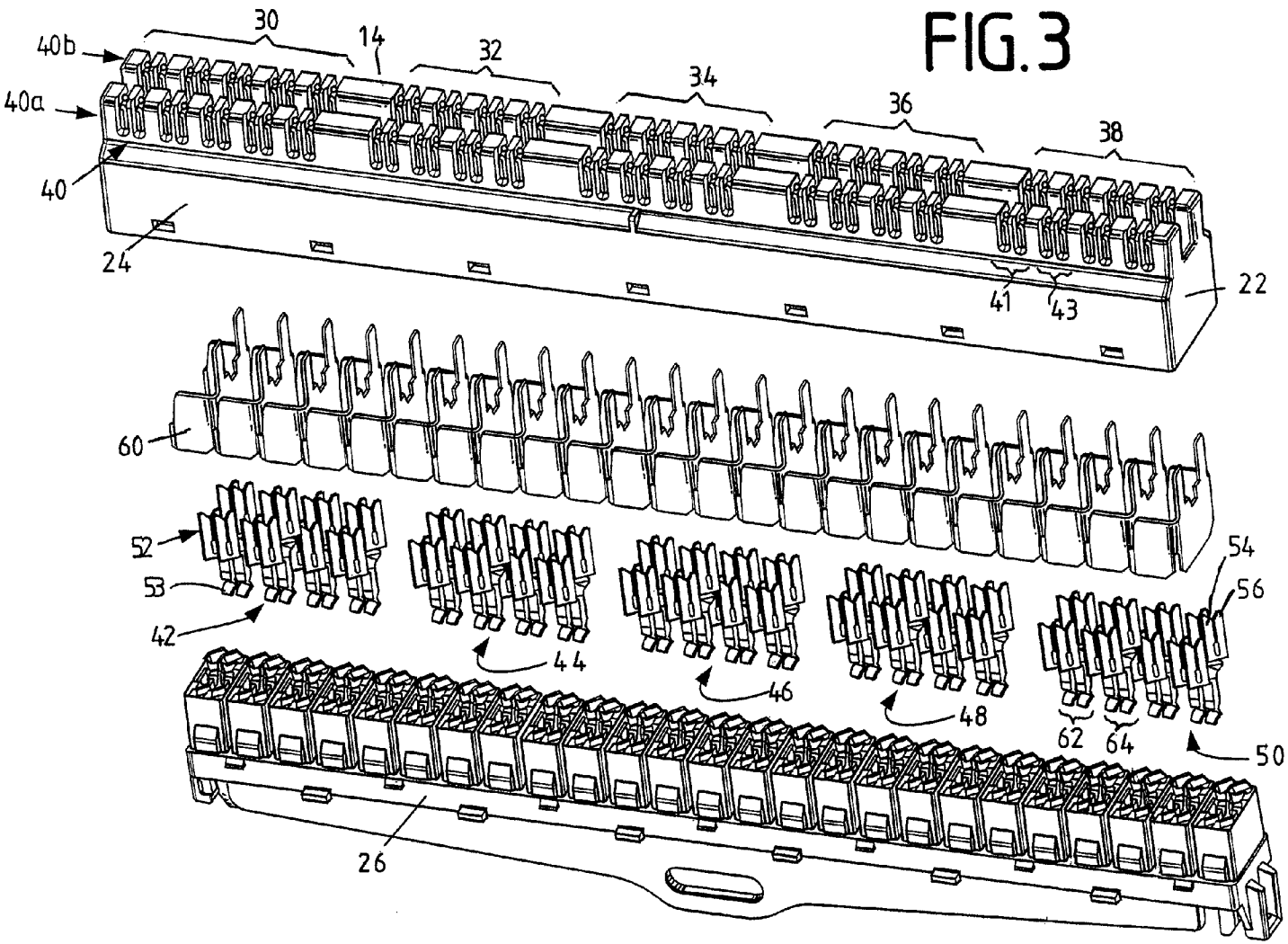
FIG. 3 is an exploded view of the connector block shown in FIG. 1.
Figure 4:
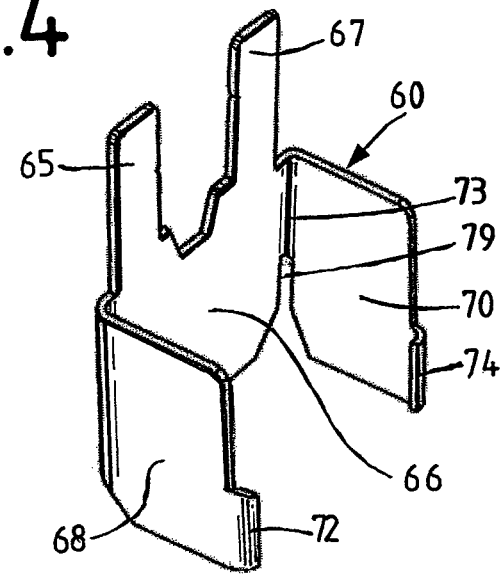
FIG. 4 is a perspective view of a screen.
Figure 5:
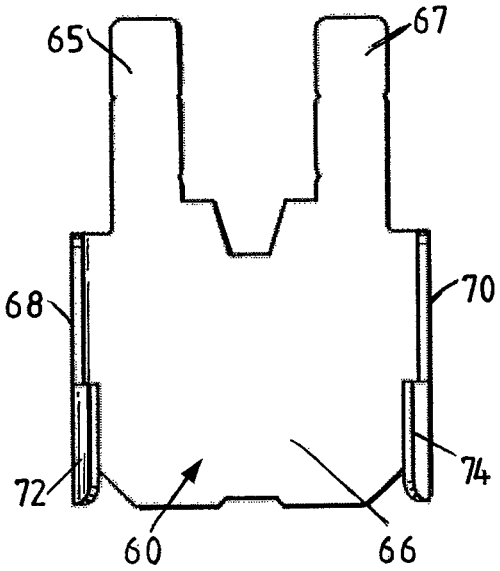
FIG. 5 is a top view of the screen shown in FIG. 4.
Figure 6:
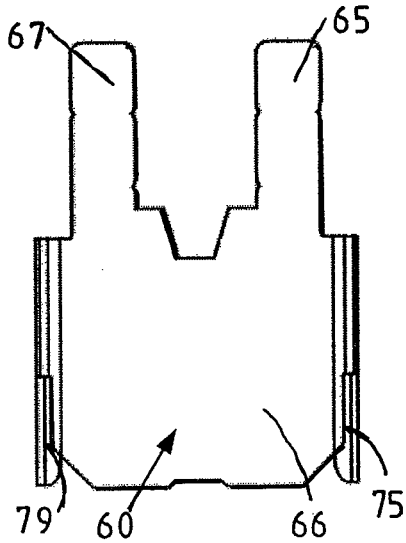
FIG. 6 is a bottom view of the screen shown in FIG. 4.
Figure 7:
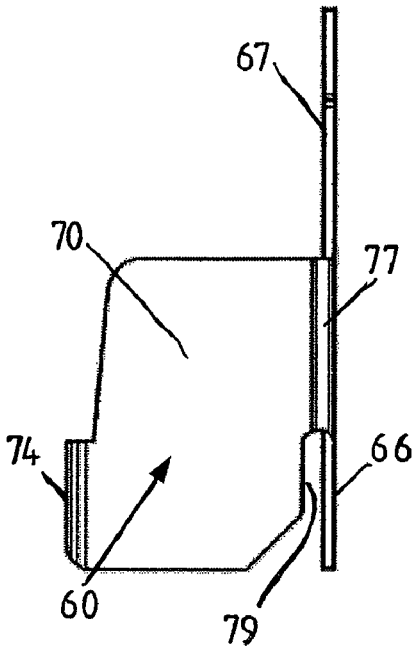
FIG. 7 is a side view of the screen shown in FIG. 5.
Figure 8:
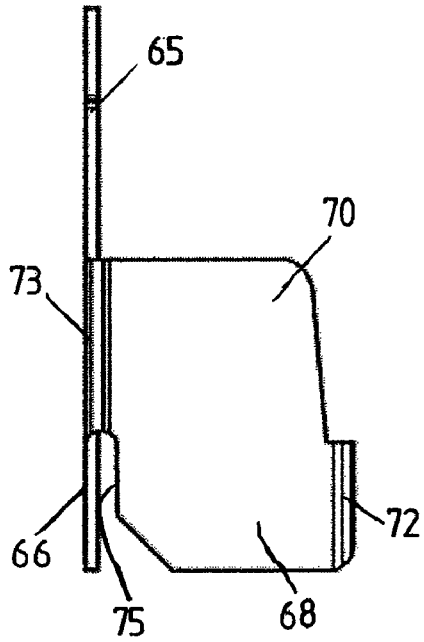
FIG. 8 is another side view of the screen shown in FIG. 4.

As shown in particular in FIG. 3, the connector block 10 includes five groups 30, 32, 34, 36, 38 of insulation displacement contact slots 40 arranged in series along the front side 14 of the housing 12. Each group 30, 32, 34, 36, 38 includes first and second rows 40*a*, 40*b* of insulation displacement contact slots 40 that extend side by side along the front side 14 of the housing 12. The insulation displacement contact slots 40 of each group 30, 32, 34, 36, 38 of slots are arranged in pairs 41, 43 for terminating the insulated conductors of corresponding twisted pairs of the above-mentioned data cables.

The connector block 10 includes five groups 42, 44, 46, 48, 50 of electric connectors 52, such as insulation displacement contacts (IDCs), arranged between the front piece 24 and the base piece 26. Each IDC 52 is preferably formed from a contact element which is bifurcated so as to define two opposed contact portions 54, 56 separated by a slot into which an insulated wire (conductor lead) may be pressed so that edges of the contact portions engage and displace the insulation and such that the contact portions resiliently engage and make electrical connection with the conductor of the insulated wire. The described IDCs 52 are explained in greater detail in U.S. Pat. No. 4,452,502 and U.S. Pat. No. 4,405,187, for example.

The IDCs 52 are arranged in fixed positions with respect to the insulation displacement contact slots 40 such that the contact portions 54, 56 of each IDC 52 extend, at least partially, into a corresponding insulation displacement contact slot 40. Each insulation displacement contact slot 40 is adapted to receive an end portion of a corresponding insulated conductor of a data cable. The end portion of each insulated conductor can be electrically connected to a corresponding IDC 52 by pressing the end portion of the conductor between the opposed contact portions 54, 56. An example of the described arrangement of insulation displacement contact slots 40 and IDCs 52 of the connector block 10 is set out in U.S. Pat. No. 4,541,682.

The IDCs 52 of the row 40*a* of slots are electrically connected to respective IDCs 52 of the row 40*b* of slots by spring finger contacts 53 extending there between. Accordingly, the insulated conductors of a first data cable (not shown) that are electrically connected, for example, to the IDCs 52 of the first row 40*a* of the first group 42 of connectors are also electrically connected to respective insulated conductors of another data cable (not shown) electrically connected to the IDCs 52 of the second row 40*b* of the first group 42 connectors. An example of the described arrangement of insulation displacement contact slots 40 and IDCs 52 of the connector block 10 is set out in U.S. Pat. No. 4,541,682.

The group 30 of insulation displacement contact slots 40 includes in each case five pairs of slots in the first and second rows 40*a* and 40*b*. The pair of insulation displacement contact slots 40 of the first row 40*a* and of the second row 40*b* closest to the first end 20 of the housing 14 is redundant. The connector block 10 preferably does not include corresponding insulation displacement contacts 52 for these two pairs of insulation displacement contact slots 40, four-sided screening for the adjacent pair of insulation displacement contacts 52 being formed here by insertion of a screen 60.

The connector block 10 includes a plurality of electrically conductive screens 60 arranged between the front piece 24 and the base piece 26 of the housing 12. The screens 60 are arranged to reduce electromagnetic coupling between adjacent pairs 62, 64 of IDCs 52, for example. In this case, each pair 62, 64 includes in each case two IDCs 52 for the first row 40*a* and two IDCs 52 for the second row 40*b*, the contacts of the first row 40*a* being connected to the contacts of the second row 40*b* via the spring finger contacts.

Figure 9:
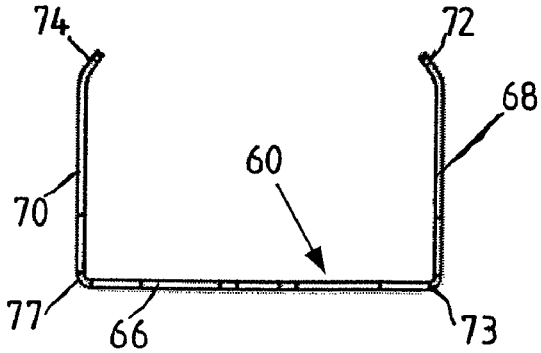
FIG. 9 is a front view of the screen shown in FIG. 4.
Figure 10:
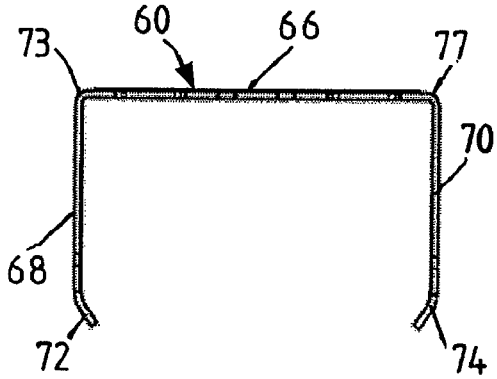
FIG. 10 is a back view of the screen shown in FIG. 4.

The screen 60 shown in FIGS. 4 to 10 includes a generally rectangular plate 66 and generally rectangular side plates 68, 70 extending in a common direction from respective left and right sides of the plate 66. The printed circuit boards 68, 70 in this case lead off at right angles from the plate 66, disregarding curvatures. The screen 60 includes two spaced apart projections 65, 67 extending upwardly from the plate 66. The projections 65, 67 lie in the same plane as the plate 66. The three plates 66, 68, 70 of the screen 60 are formed in a "U" shape when viewed from the top, as shown in FIG. 9.

The screen 60 is formed of an electrically conductive material, such as an electrically conductive metal or an electrically conductive polymer, or a non-conductive material that has been coated with an electrically conductive material. The screen 60 may be constructed of any material that allows substantial electrical conductivity to the majority of points on the screen 60, thus forming a barrier to electromagnetic fields from three aspects. The screen 60 may be constructed entirely of an electrically conductive metallic material such as copper, a copper alloy, steel or aluminium, or of non-electrically conductive materials (for example plastic) coated with an electrically conductive metallic layer.

The screen 60 is preferably made of a conductive metallic material and is integrally formed, in particular punched, from a metal sheet (not shown) with the plate 66; the side plates 68, 70; and the two projections 65, 67 initially lying in the same plane as the metal sheet. In a work step that follows the cutting out process, the side plates 68, 70 are bent so that they extend outwardly at an angle of 90° with respect to the above-mentioned plane. A hinge 73 is formed between the plate 66 and the plate 68 if they have been bent in the described manner. The hinge 73 extends only partially along the common, adjacent, edges of the plates 66, 68 thereby leaving an aperture, or slot, 75 between the plates 66, 68 (see also FIG. 8). The slot 75 is preferably located at a bottom end of the plates 66, 68. Similarly, a hinge 77 is formed between the plate 66 and the plate 70 when they are bent in the described manner. The hinge 77 extends only partially along common, adjacent, edges of the plates 66, 70 thereby leaving an aperture, or slot, 79 between the plates 66, 70. The slot 79 is preferably located at a bottom end of the plates 66, 70.

In a further processing step, the distal end sections 72, 74 of side plates 68 and 70 are bent so as to curve inwardly towards each other. The distal ends 72, 74 are preferably shaped for at least partial insertion into the corresponding slots 75, 79 of a next successive screen 60 in a series of screens 60. For this purpose, the distal ends 72, 74 are arranged on the bottom end of the end faces of printed circuit boards 68, 70 and do not extend over the full length of the end face.

Figure 11:
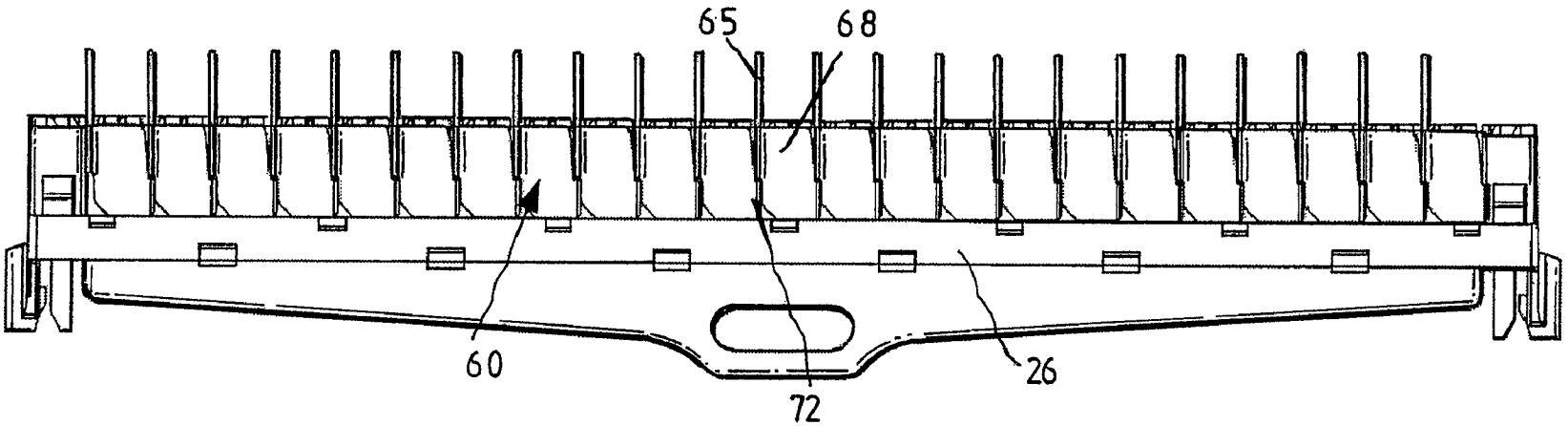
FIG. 11 is a top view of the connector block shown in FIG. 1 with part of the housing removed.

In use, the screens 60 are arranged in a row along the extent of the base piece 26 between adjacent pairs 62, 64 of IDCs 52 in the manner shown in FIG. 11. The plate 66 of each screen 60 is of suitable size to fit between adjacent pairs 62, 64 of IDCs 52. The plate 66 of each screen is also of suitable size and shape to extend between the rows 40*a*, 40*b* of IDCs 52. The side plates 68, 70 of each screen 60 are of suitable size and shape to come into contact preferably with the plates 66 of the next screen 60 in the series. When so arranged, the screens 60 are held in electrical communication with each other. An electrical connection between all screens 60 is effected when they are arranged in the manner shown in FIG. 11. The series of electrically connected screens 60 is advantageous in the earthing of electrical and magnetic fields incident on the conductive surfaces of the conductive screens 60.

The side plates 68, 70 are preferably slightly longer than the distance between adjacent pairs 62, 64 of IDCs 52. In this embodiment, the side plates 68, 70 of each screen 60 are adapted to at least partially deform so as to resiliently bear against the next screen 60 in the series. The bent end sections 72, 74 control the deformation of the side plates 68, 70 so that they move towards each other when the screens are fitted in the manner shown in FIG. 11. The controlled deformation of the side plates 68, 70 advantageously holds the screens 60 in electrical communication with each other.

Alternatively, the side plates 68, 70 of each screen 60 are of suitable size and shape so that the bent end sections 72, 74 of each side plate 68, 70 are adapted to be at least partially inserted into corresponding slots 75, 79 of the next screen 60 in the series. When so arranged, the screens 60 are mechanically connected together. Further, when so arranged, the screens 60 are held in electrical communication with each other. An electrical connection between all screens 60 is effected when they are arranged in the manner shown in FIG. 11. The series of electrically connected screens 60 is advantageous in the earthing of electrical and magnetic fields incident on the conductive surfaces of the conductive screens 60.

The spaced apart projections 65, 67 are shaped to screen the contact portions of the IDCs 52. The projections 65, 67 extend into hollow pedestals 76 formed in the front side 14 of the housing 12 of the connector block 10.

In the described arrangement, the series of screens 60 reduces the effects of electromagnetic radiation on pairs of IDCs 52 from four aspects. The series of screens 60 surrounds each pair 62 of IDCs 52 with four electrically conductive surfaces. The screens 60 thereby reduce the effects of electromagnetic radiation on each pair 62 of IDCs 52 from neighbouring pairs 64 of IDCs 52. Advantageously, the series of screens 60 reduces the effects of crosstalk in high frequency data communications. It should be pointed out here that in each case two pairs of IDCs are then located within a screen, namely one pair for the row 40*a* and one pair for the row 40*b*.

In an alternative arrangement, the series of screens 60 are mechanically coupled together so that they form a single structure. The side plates 68, 70 of each screen 60 are mechanically connected to the plate 66 of the next successive screen 60 in the series. The screens 60 are electrically coupled together by the mentioned mechanical connections. The series of screens 60 is adapted to be inserted into the base piece 26 of the housing as a single unit to reduce crosstalk.

Figure 12:
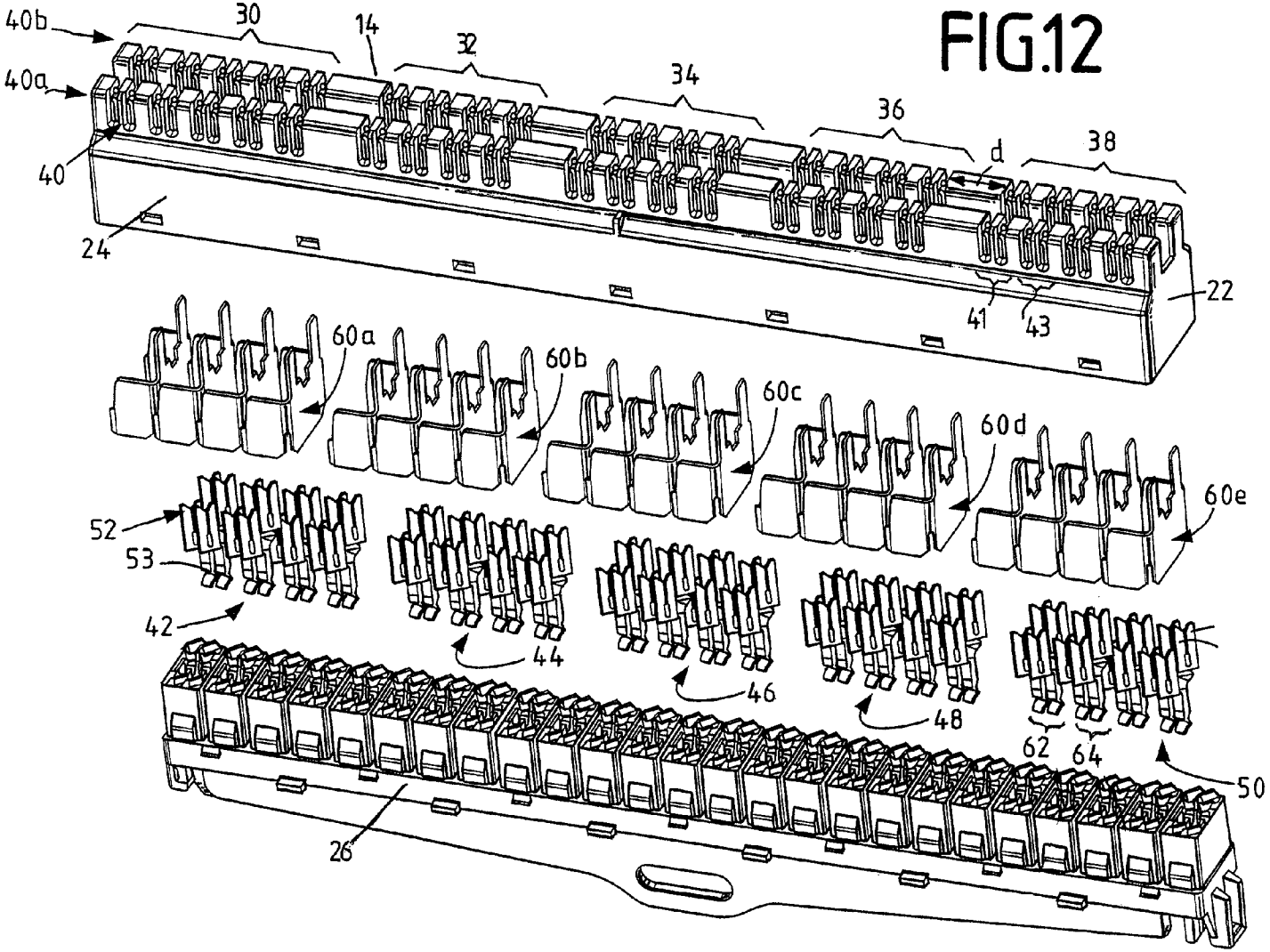
FIG. 12 is an exploded view of the connector block shown in FIG. 1 with an alternative arrangement of screens.

The connector block 10 shown in FIG. 12 includes five groups of electrically conductive screens 60*a*, 60*b*, 60*c*, 60*d*, 60*e* arranged in series along the extent of the housing 12 between the first and second ends 20, 22. Each group 60*a*, 60*b*, 60*c*, 60*d*, 60*e* of screens 60 is held in electrical isolation from its neighbouring groups of screens.

The groups 60*a*, 60*b*, 60*c*, 60*d*, 60*e* of screens 60 provide electromagnetic screening for pairs 62, 64 of IDCs 52 of corresponding groups 42, 44, 46, 48, 50 of connectors. In this arrangement, the screens 60 of each group 60*a*, 60*b*, 60*c*, 60*d*, 60*e* provide electromagnetic screening for three out of four of the pairs 62, 64 of IDCs 52 from four aspects. The remaining pair of IDCs 52 is screened from three aspects only. The distance d between adjacent groups 30, 32, 34, 36, 38 of insulation displacement contact slots 40 is preferably sufficient to reduce the effects of electromagnetic radiation on the pair of IDCs 52 that is screened from three aspects only.

Alternatively, the distance d between adjacent groups 60*a*, 60*b*, 60*c*, 60*d*, 60*e* of screens 60 is sufficient to include an additional screen in the series so that each group 62, 64 is screened from four aspects. In this embodiment, each group 60*a*, 60*b*, 60*c*, 60*d*, 60*e* includes five screens 60. Instead of a fifth screen 60, a single additional plate can also screen the second side.

Electrically conductive materials for constructing each screen 60 preferably include aluminium, steel, iron, copper, silver, gold, doped silicon, and conductive polymer. Preferable electrically insulating materials for construction of parts of said screen include plastic, resin, glass and rubber. For screens constructed at least in part of insulating materials, at least one surface of each of the plates 66, 68, 70 is coated with an electrically-conductive coating. Preferable coatings for non-insulating surfaces include immersion coating and deposition of one or more of the following materials: aluminium, steel, iron, copper, silver, gold, doped silicon and conductive polymer. A sufficient coating may include a thin coating on one or both surfaces of each plate, or a grid pattern with sufficiently small gaps to attenuate electromagnetic transmission. The thickness of any conductive plate or conductive screening is sufficient to substantially attenuate the propagation of electromagnetic radiation at the frequencies radiated by the IDCs and any conductors which may be terminated therein.

While we have shown and described specific embodiments of the present invention, further modifications and improvements will occur to those skilled in the art. We desire it to be understood, therefore, that this invention is not limited to the particular forms shown and we intend in the appended claims to cover all modifications that do not depart from the spirit and scope of this invention.

Throughout this specification, unless the context requires otherwise, the word "comprise", and variations such as "comprises" and "comprising", will be understood to imply the inclusion of a stated feature or step or group of features or steps but not the exclusion of any other feature or step or group of features or steps.

The reference to any prior art in this specification is not, and should not be taken as, an acknowledgment or any form of suggestion that the prior art forms part of the common knowledge of those skilled in the art.

The invention claimed is:

1. A screen for reducing electromagnetic coupling between first and second adjacent pairs of electric connectors arranged in a series of pairs of electric connectors in a connector block, comprising:

(a) a first electrically conductive surface shaped for arrangement between the first and second adjacent pairs of electric connectors, the first electrically conductive surface including two spaced apart projections arranged on a common end of the first electrically conductive surface;

(b) two spaced apart electrically conductive surfaces electrically coupled to, and extending transversely away from, respective sections of said first electrically conductive surface in a common direction, and forming three-sided screening for a pair of electric connectors.

2. A screen according to claim 1, wherein the screen is formed integrally.

3. A screen according to claim 1, wherein the screen has at least one means, by means of which the screen can be electrically and/or mechanically connected to a further screen in order to form four-sided screening.

4. A screen according to claim 3, wherein the distal ends of the spaced apart surfaces have a curvature.

5. A screen according to claim 4, wherein the distal ends extend only over part of the length of the end faces of the spaced apart surfaces.

6. A screen according to claim 3, wherein the screen has at least one second means, which can produce, with a first means of a second screen, an electrical and/or mechanical connection.

7. A screen according to claim 6, wherein the second means is an opening.

8. A screen according to claim 7, wherein the opening includes at least one slot.

9. A screen according to claim 8, wherein the slot is located between adjacent edges of the first surface and at least one of the two spaced apart surfaces.

10. A screen according to claim 9, wherein the slot is located on the bottom end of the surfaces.

11. A screen according to claim 1, wherein the first electrically conductive surface and/or the two spaced apart surfaces are electrically conductive plates.

12. A screen according to claim 1, wherein the two spaced apart electric surfaces extend at an angle of 90 degrees to said first electric surface.

13. A screen according to claim 1, wherein the screen is constructed of metal or a non-metallic electrically conductive material.

14. A screen according to claim 1, wherein the screen is constructed of an electrically non-conductive material with at least a partial conductive coating.

15. A screening device, comprising:

at least two screens, each screen including a first electrically conductive surface shaped for arrangement between first and second adjacent pairs of electric connectors, the first electrically conductive surface including two spaced apart projections arranged on a common end of the first electrically conductive surface, each screen also including two spaced apart electrically conductive surfaces electrically coupled to, and extending transversely away from, respective sections of said first electrically conductive surface in a common direction, and forming three-sided screening for a pair of electric connectors, wherein the at least two screens are mechanically and electrically connected and form four-sided screening for at least one pair of electric connectors.

16. A connector block for terminating a plurality of conductors of electric data cables, the connector block comprising:

a plurality of pairs of electric connectors in at least one series for terminating said conductors, and a plurality of screens arranged around respective pairs of the electric connectors, each screen including a first electrically conductive surface shaped for arrangement between first and second adjacent pairs of the electric connectors, the first electrically conductive surface including two spaced apart projections arranged on a common end of the first electrically conductive surface, the screen also including two spaced apart electrically conductive surfaces electrically coupled to, and extending transversely away from, respective sections of said first electrically conductive surface in a common direction, and forming three-sided screening for a pair of electric connectors.

17. A connector block according to claim 16, wherein the electric connectors are arranged in groups, the groups having a distance d from an adjacent group.

18. A connector block according to claim 16, wherein the screens are arranged such that each pair of the electric connectors is provided with four-sided screening.

19. A connector block according to claim 16, wherein the connectors are insulation-displacement contacts.

20. A connector block according to claim 16, wherein the connector block has a two-piece housing, comprising a front piece and a base piece, the screens being arranged in the base piece and extending into the front piece.

21. A connector block according to claim 16, wherein the screens are split into groups, which are electrically insulated from one another.

* * * * *